US012773592B2

(12) United States Patent
Hong et al.

(10) Patent No.: US 12,773,592 B2
(45) Date of Patent: Oct. 27, 2026

(54) FITNESS BIKE AND CONTROLLING METHOD THEREOF

(71) Applicant: LG Electronics Inc., Seoul (KR)

(72) Inventors: Do Keun Hong, Seoul (KR); Jinwoo Nam, Seoul (KR); Yangtae Kwon, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 235 days.

(21) Appl. No.: 18/703,654

(22) PCT Filed: Mar. 16, 2023

(86) PCT No.: PCT/KR2023/003536
§ 371 (c)(1),
(2) Date: Apr. 22, 2024

(87) PCT Pub. No.: WO2023/177239
PCT Pub. Date: Sep. 21, 2023

(65) Prior Publication Data

US 2025/0001238 A1 Jan. 2, 2025

(30) Foreign Application Priority Data

Mar. 16, 2022 (KR) ..... 10-2022-0032477

(51) Int. Cl.
*A63B 21/22* (2006.01)
*A63B 21/00* (2006.01)
(Continued)

(52) U.S. Cl.
CPC ..... *A63B 21/225* (2013.01); *A63B 21/0051* (2013.01); *A63B 21/157* (2013.01); *A63B 23/0476* (2013.01); *A63B 24/0087* (2013.01)

(58) Field of Classification Search
None
See application file for complete search history.

(56) References Cited

U.S. PATENT DOCUMENTS 2,971,394 A * 2/1961 Christensen ..... F16D 13/08 192/81 C
4,673,177 A 6/1987 Szymski
(Continued)

FOREIGN PATENT DOCUMENTS

EP 3 067 097 B1 9/2020
KR 10-2004-0101846 A 12/2004
(Continued)

*Primary Examiner* — Shila Jalalzadeh Abyaneh
(74) *Attorney, Agent, or Firm* — Birch, Stewart, Kolasch & Birch, LLP

(57) ABSTRACT

The present invention discloses a fitness bike and a method of controlling the same. The fitness bike according to the present invention includes an operation lever configured to restrict a clutch gear unit to a flywheel to allow the flywheel to operate in a non-freewheel mode and release the restriction between the clutch gear unit and the flywheel to allow the flywheel to operate in a freewheel mode, a position detection unit installed on the flywheel to detect a rotation position of the operation lever, and a controller configured to brake the flywheel by adjusting a magnitude of a magnetic force of a stator so that the operation lever stops at a preset exposure position when a pedal is stopped.

18 Claims, 12 Drawing Sheets

(51) Int. Cl.

| | |
|---|---|
| ***A63B 21/005*** | (2006.01) |
| ***A63B 23/04*** | (2006.01) |
| ***A63B 24/00*** | (2006.01) |

(56) References Cited

U.S. PATENT DOCUMENTS

| | | | | | |
|---|---|---|---|---|---|
| 5,961,424 | A * | 10/1999 | Warner | B62M 1/10 482/119 |
| 6,379,285 | B1 * | 4/2002 | Maresh | A63B 22/0605 482/57 |
| 7,530,932 | B2 | 5/2009 | Lofgren et al. | |
| 8,062,183 | B2 | 11/2011 | Rice | |
| 9,243,692 | B2 | 1/2016 | Wesling | |
| 11,187,285 | B2 | 11/2021 | Wrobel | |
| 2007/0089959 | A1 | 4/2007 | Kanehisa | |
| 2014/0235383 | A1 | 8/2014 | Wesling | |
| 2019/0178313 | A1 | 6/2019 | Wrobel | |
| 2022/0074454 | A1 * | 3/2022 | Wrobel | F16D 41/04 |
| 2022/0074455 | A1 | 3/2022 | Wrobel | |
| 2022/0347515 | A1 * | 11/2022 | Muhic | A63B 21/225 |
| 2023/0304548 | A1 | 9/2023 | Wrobel | |

FOREIGN PATENT DOCUMENTS

| | | | | |
|---|---|---|---|---|
| KR | 10-2007-0038634 | A | 4/2007 | |
| KR | 10-2017-0142720 | A | 12/2017 | |
| KR | 20170142720 | A * | 12/2017 | B62M 1/12 |
| KR | 10-2304923 | B1 | 9/2021 | |
| WO | WO 2019/113521 | A1 | 6/2019 | |

* cited by examiner

[Fig. 1]
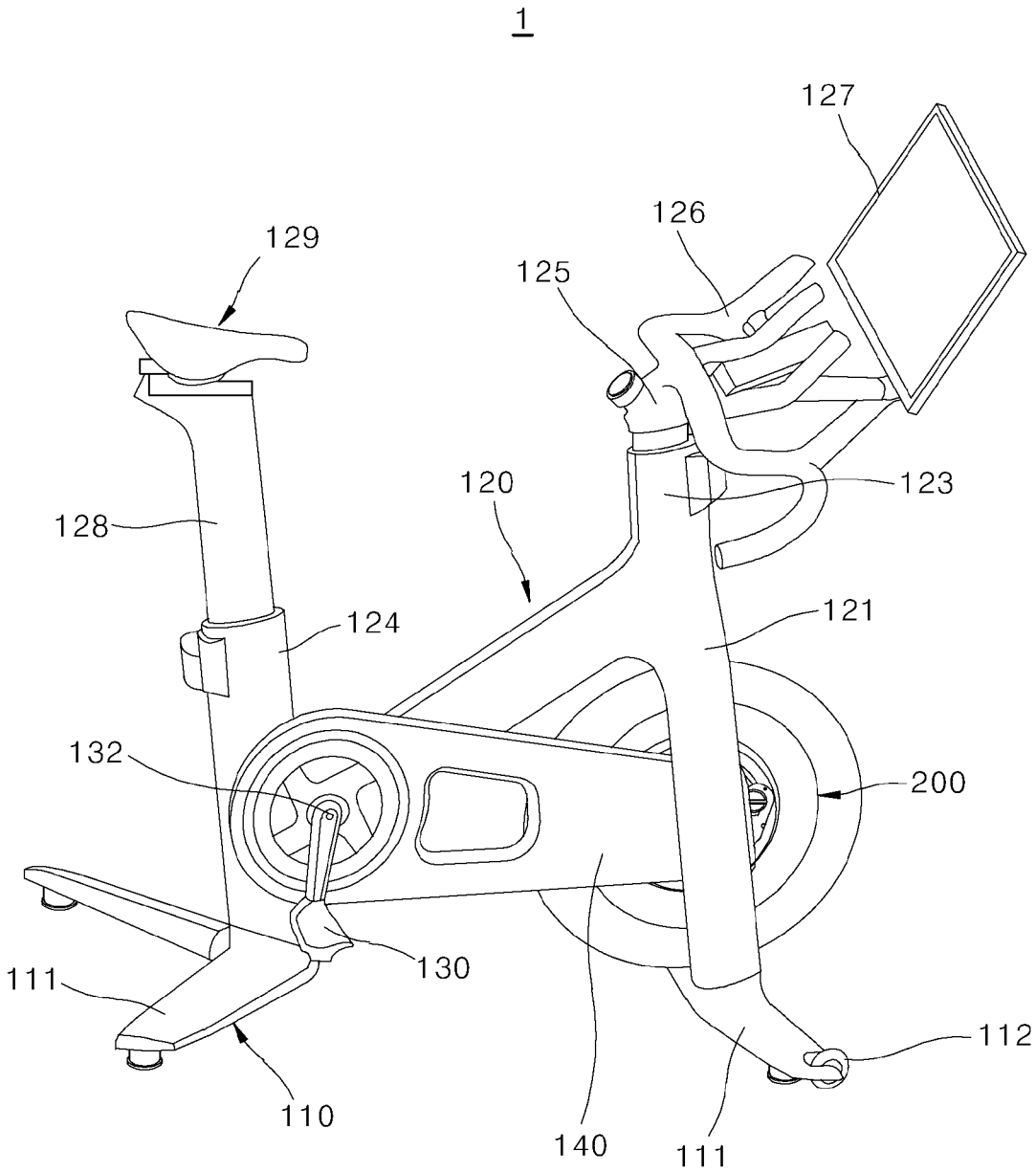

[Fig. 2]
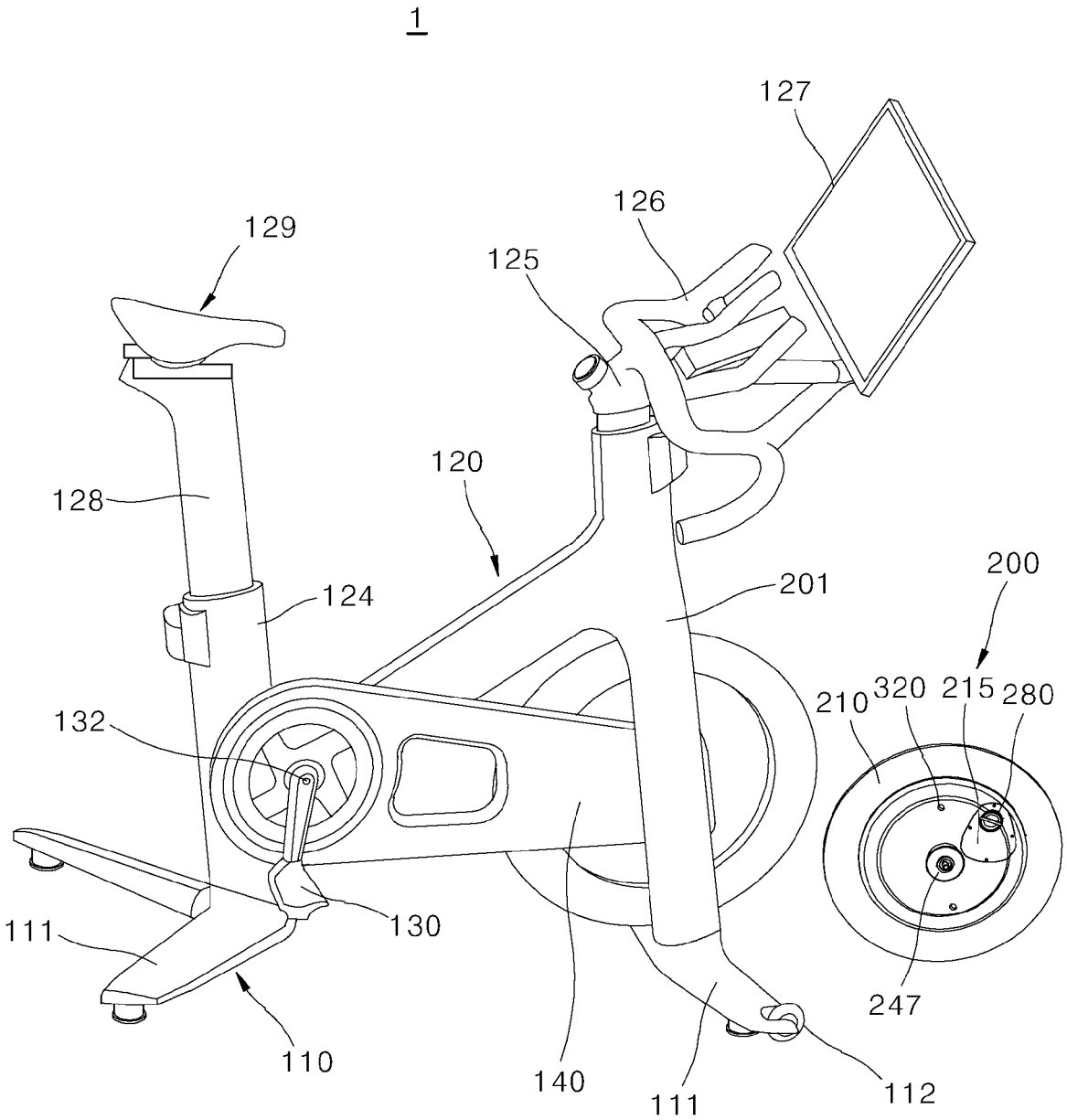

[Fig. 3]
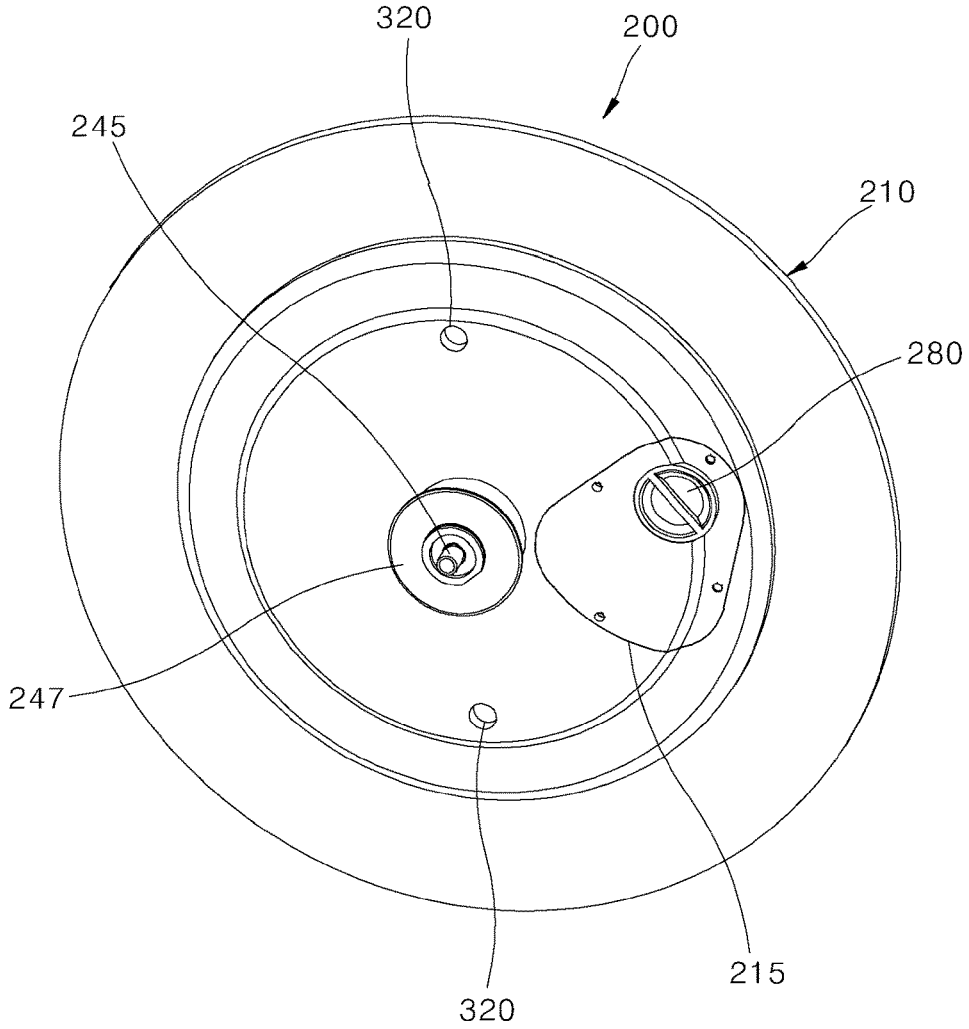
[Fig. 4]
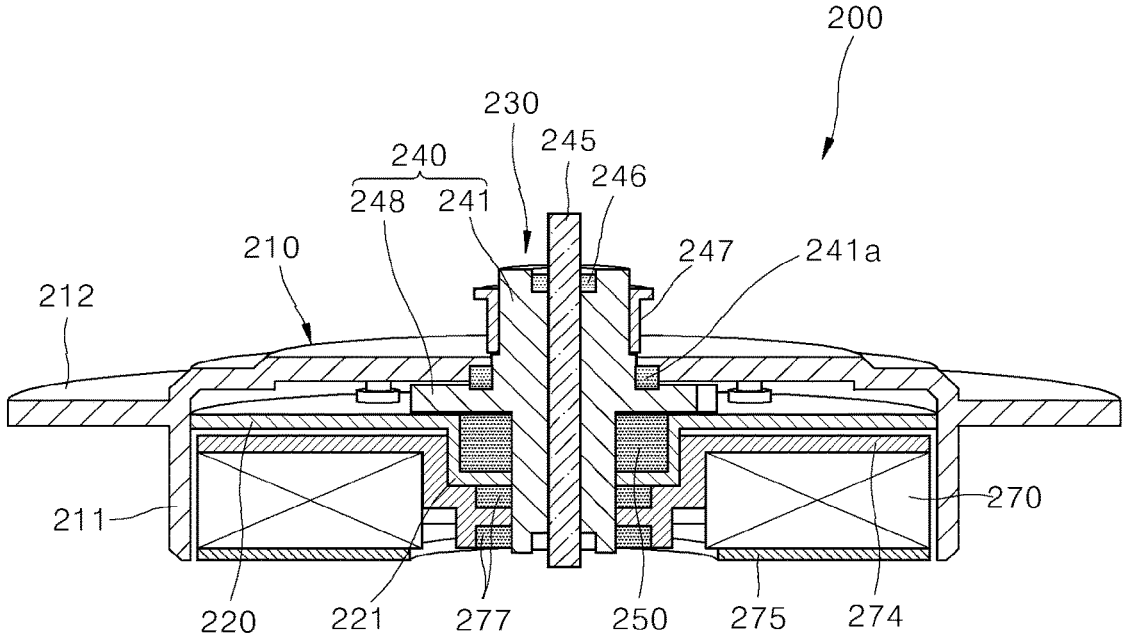

[Fig. 5]
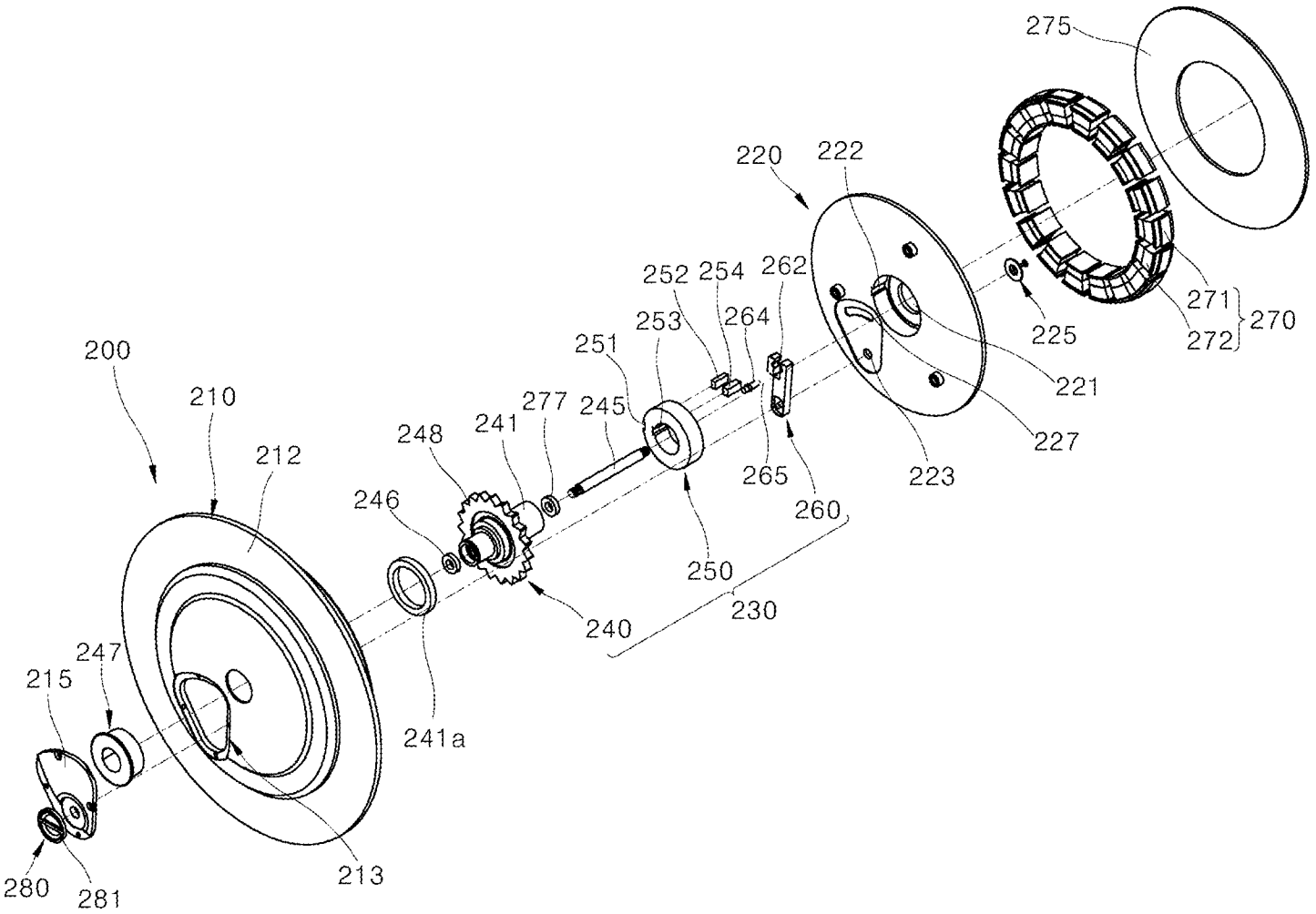

[Fig. 6]
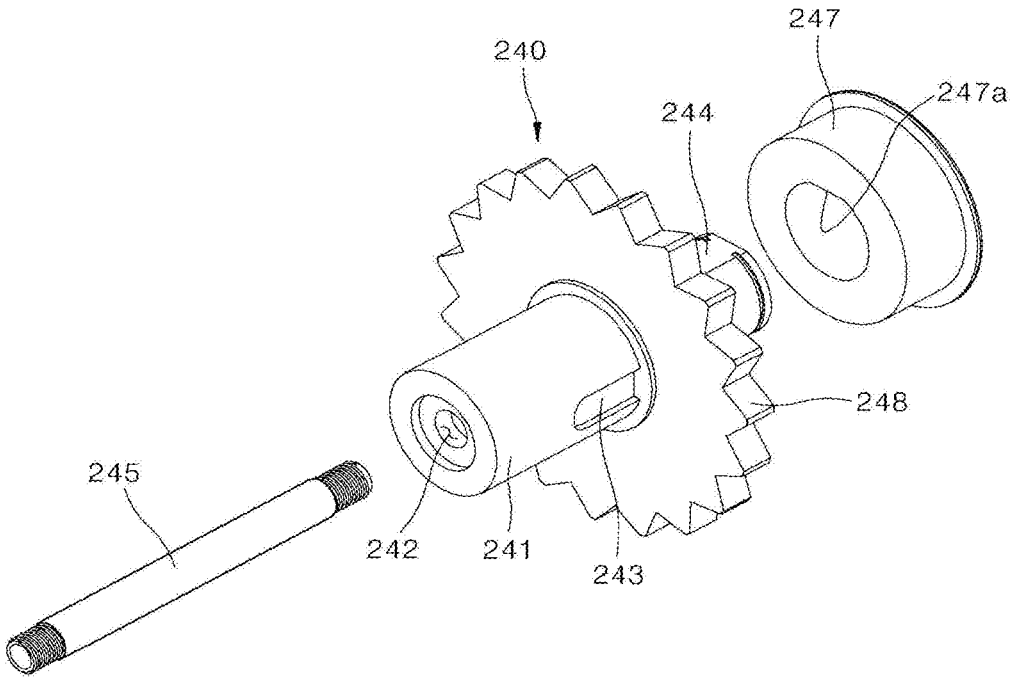
[Fig. 7]
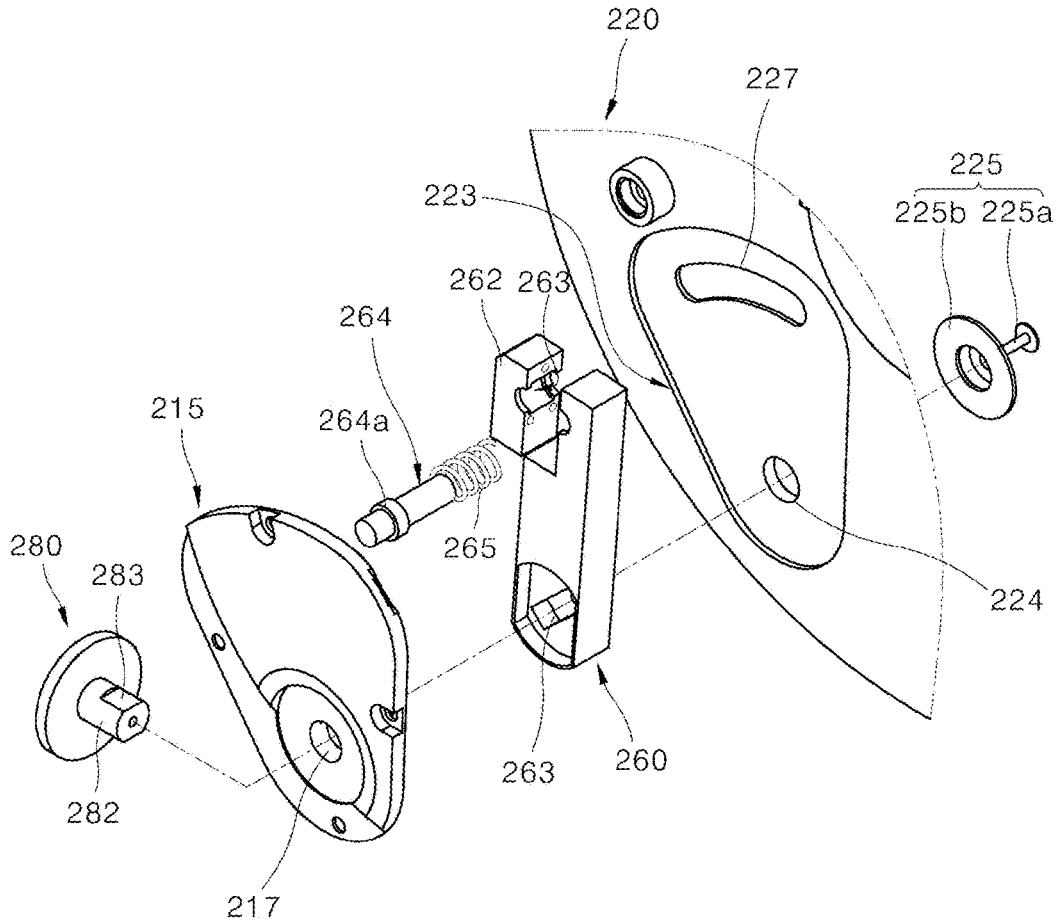

[Fig. 8]
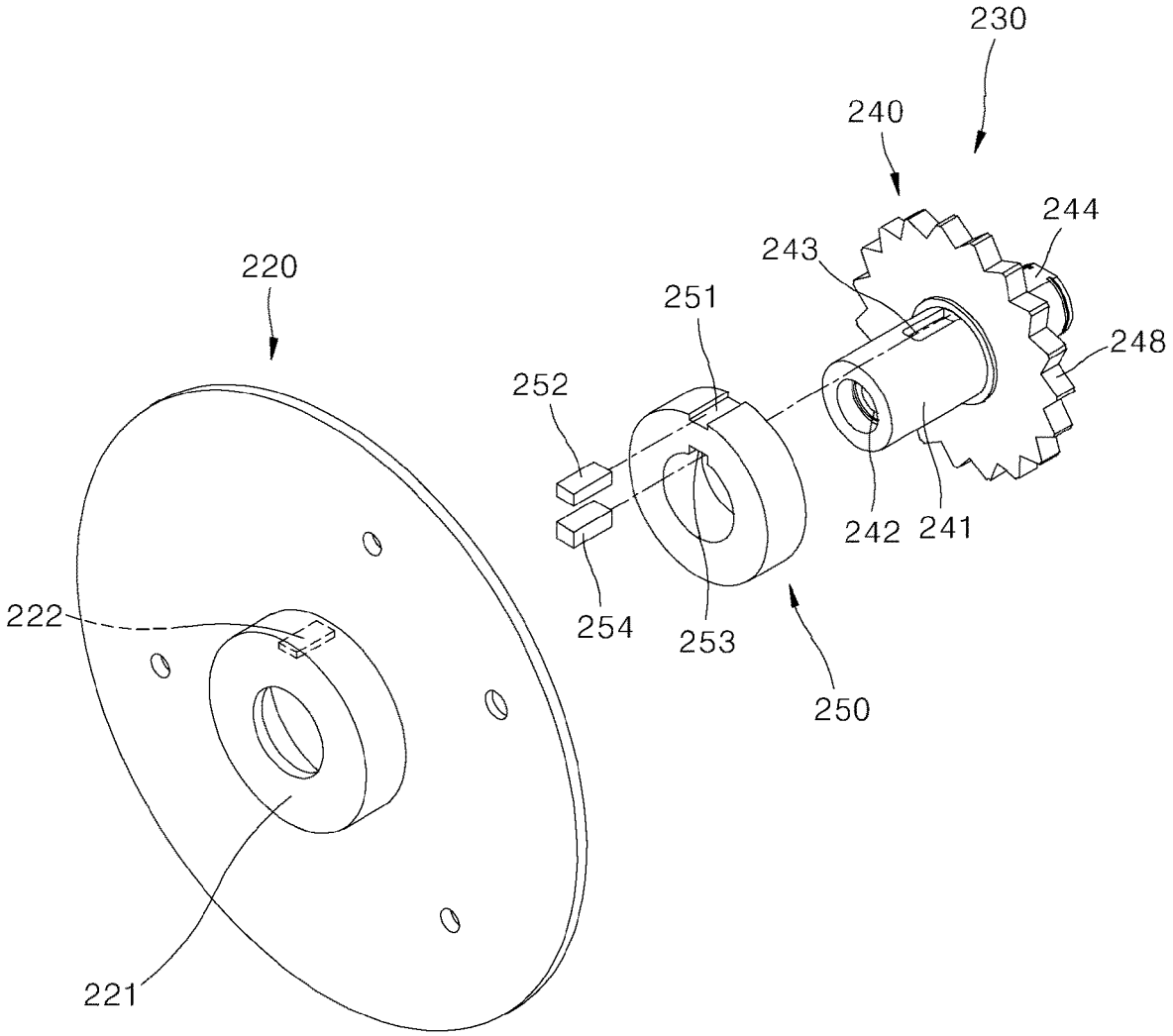

[Fig. 9]
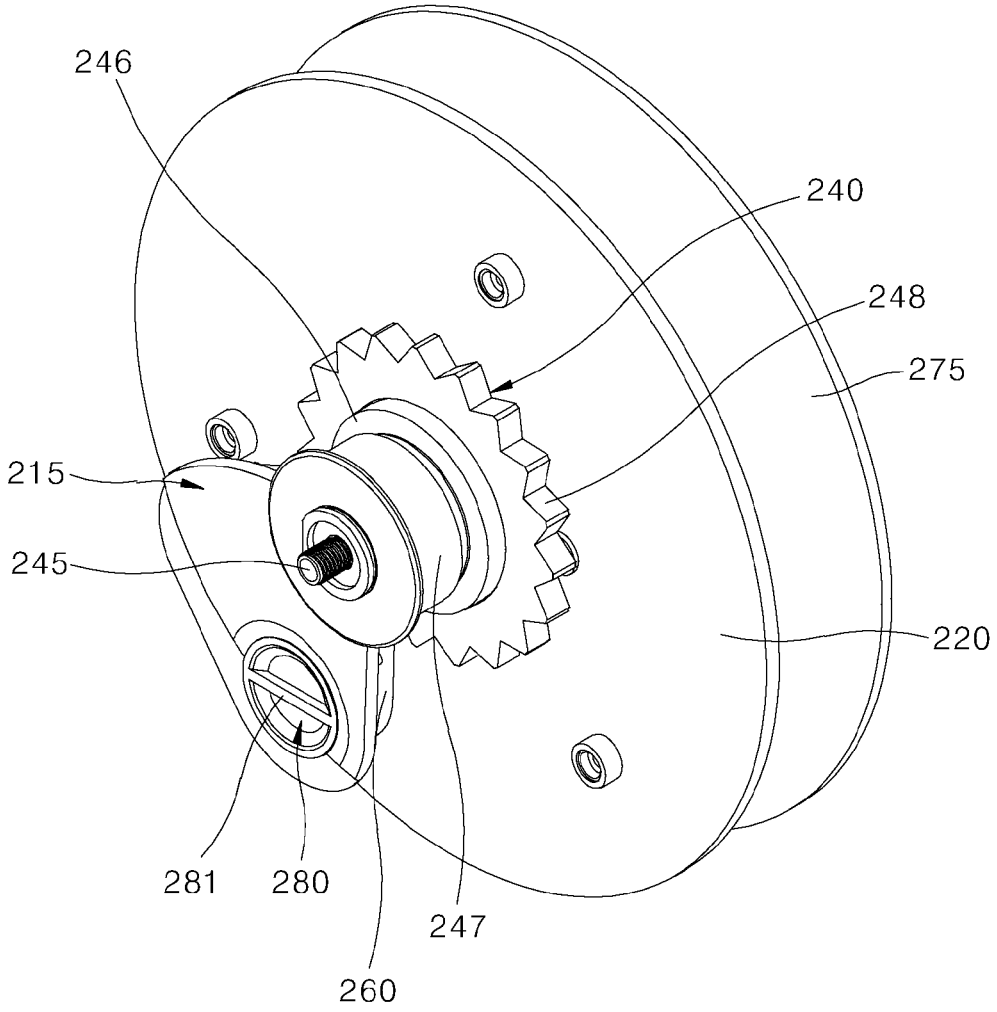

[Fig. 10]
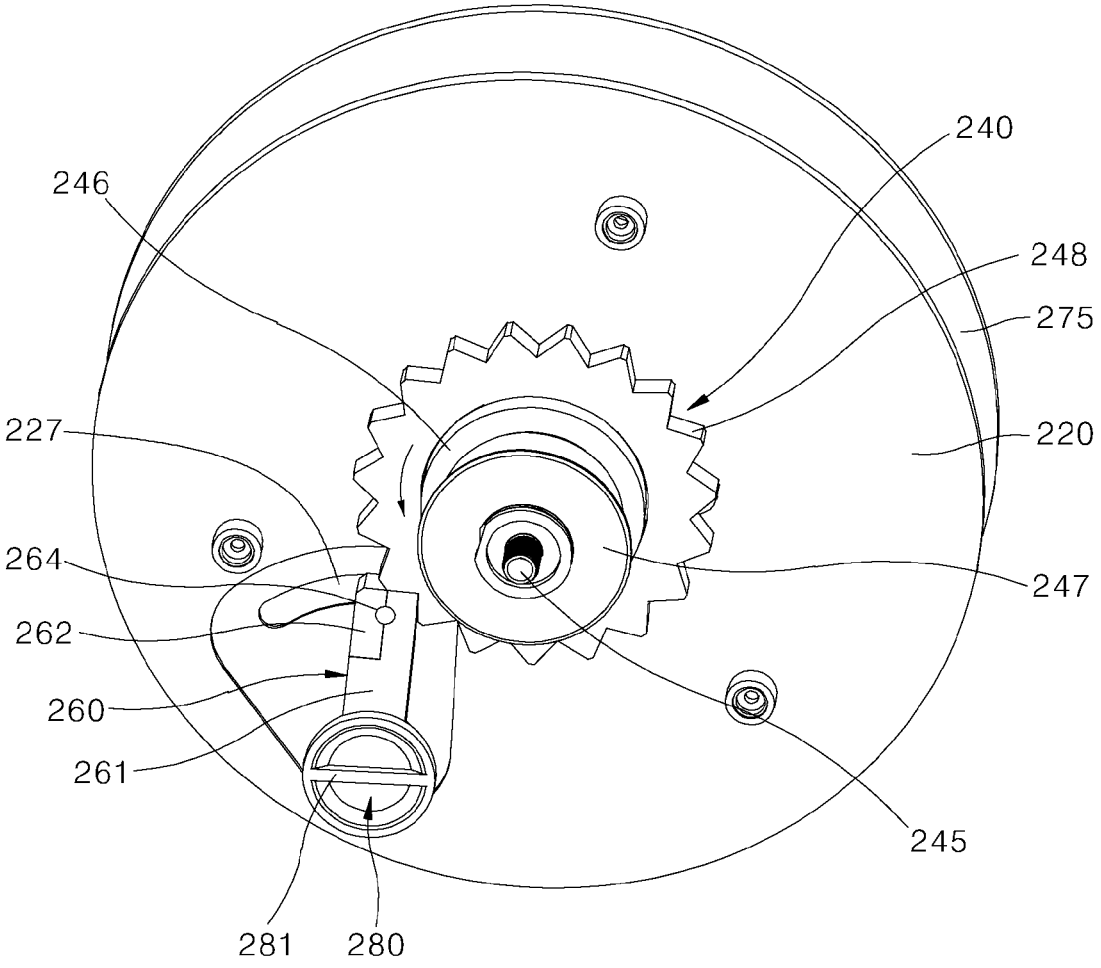

[Fig. 11]
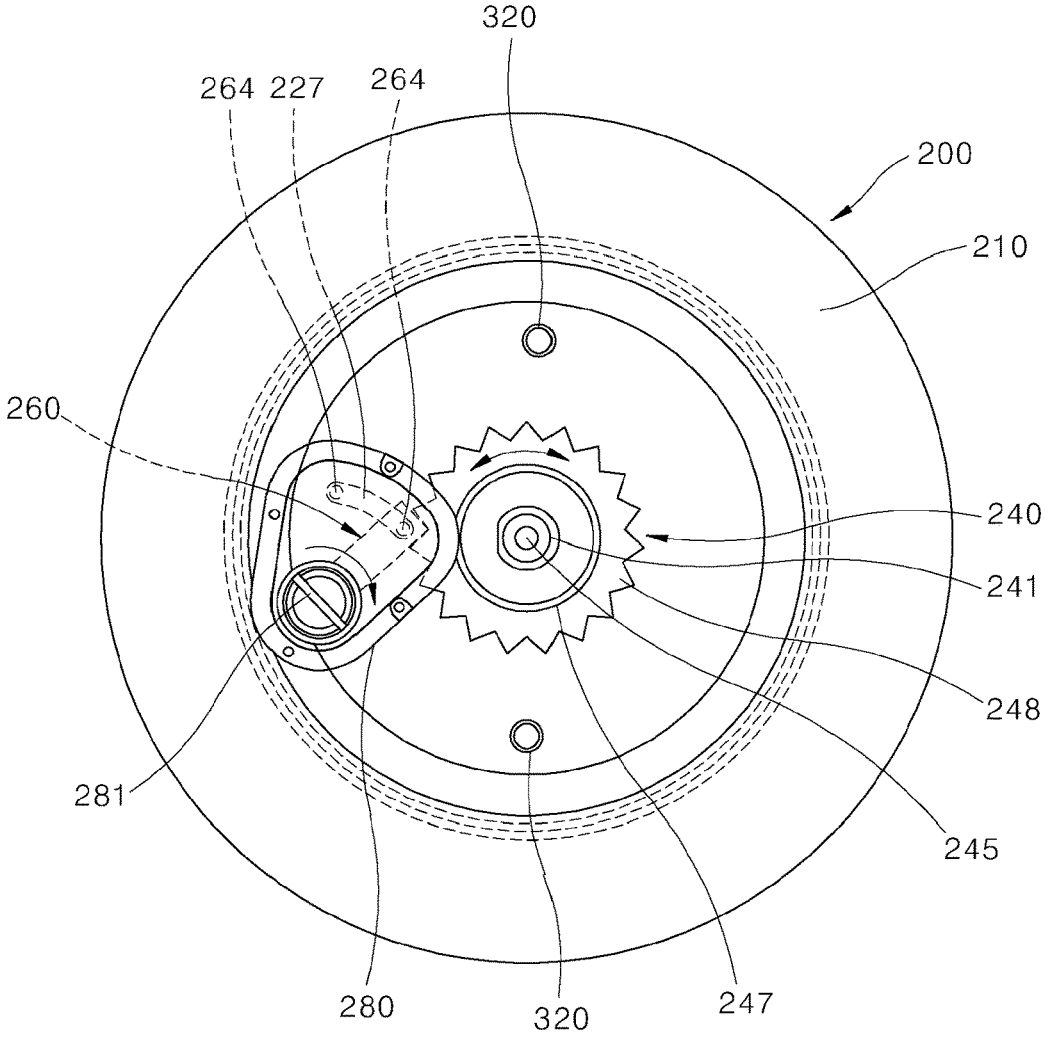
[Fig. 12]
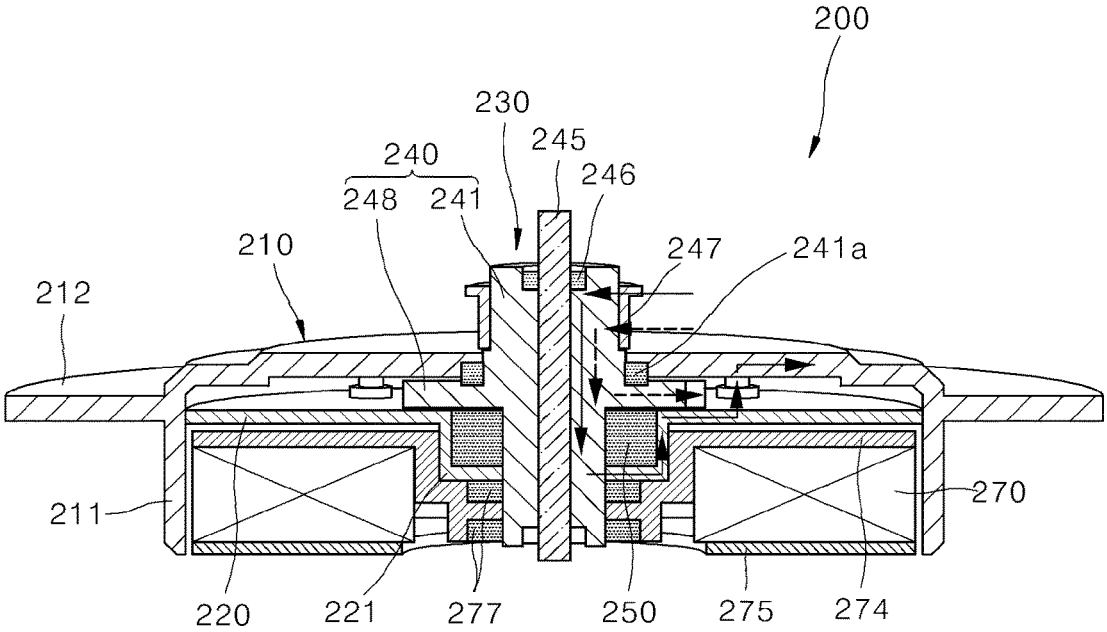

[Fig. 13]
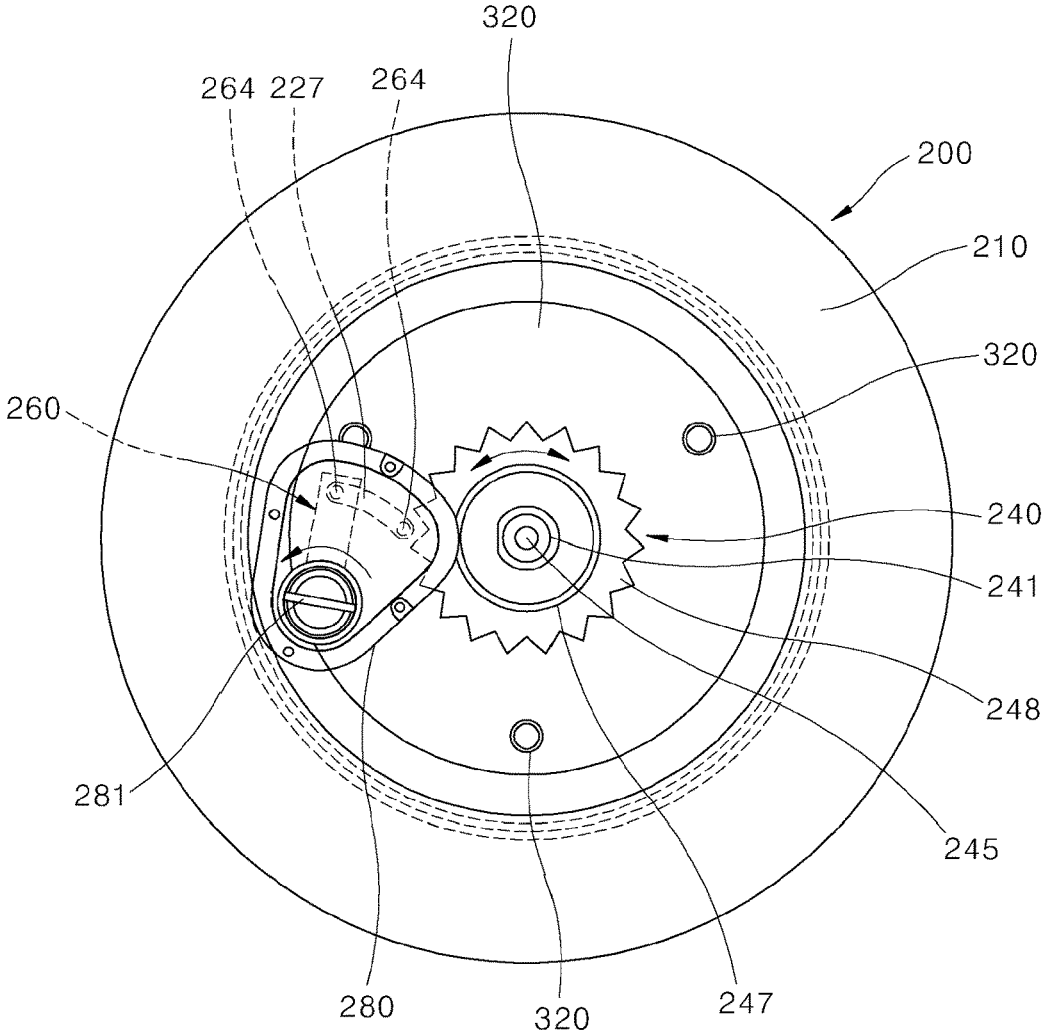
[Fig. 14]
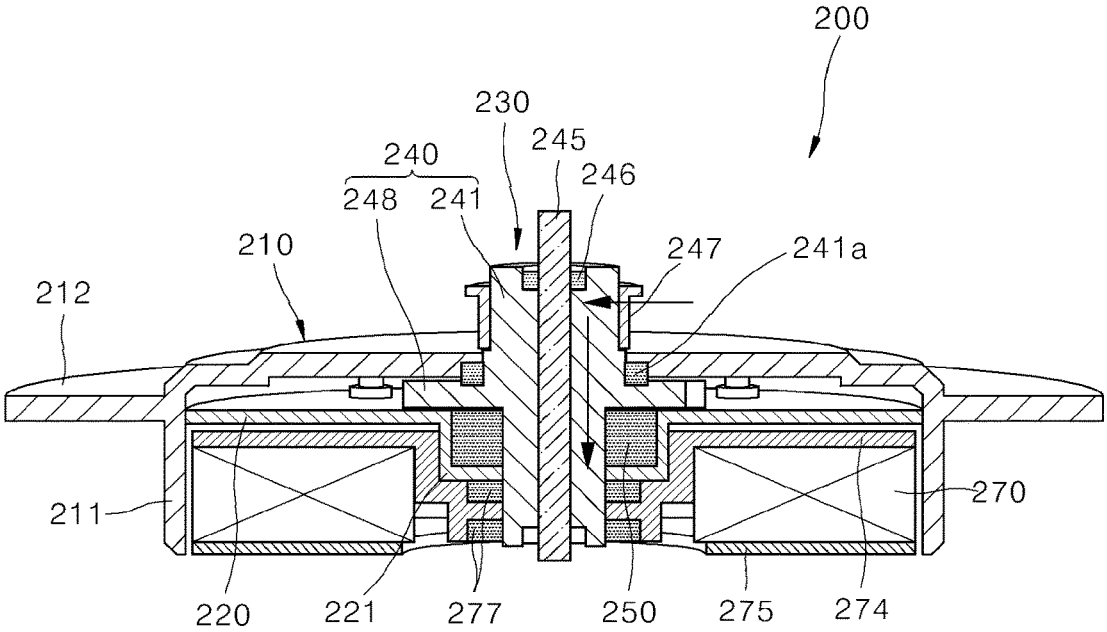

[Fig. 15]
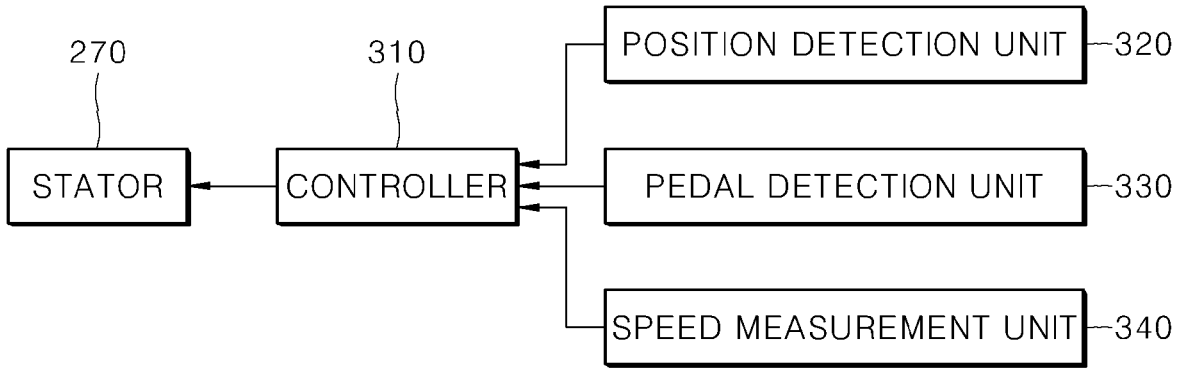
[Fig. 16]
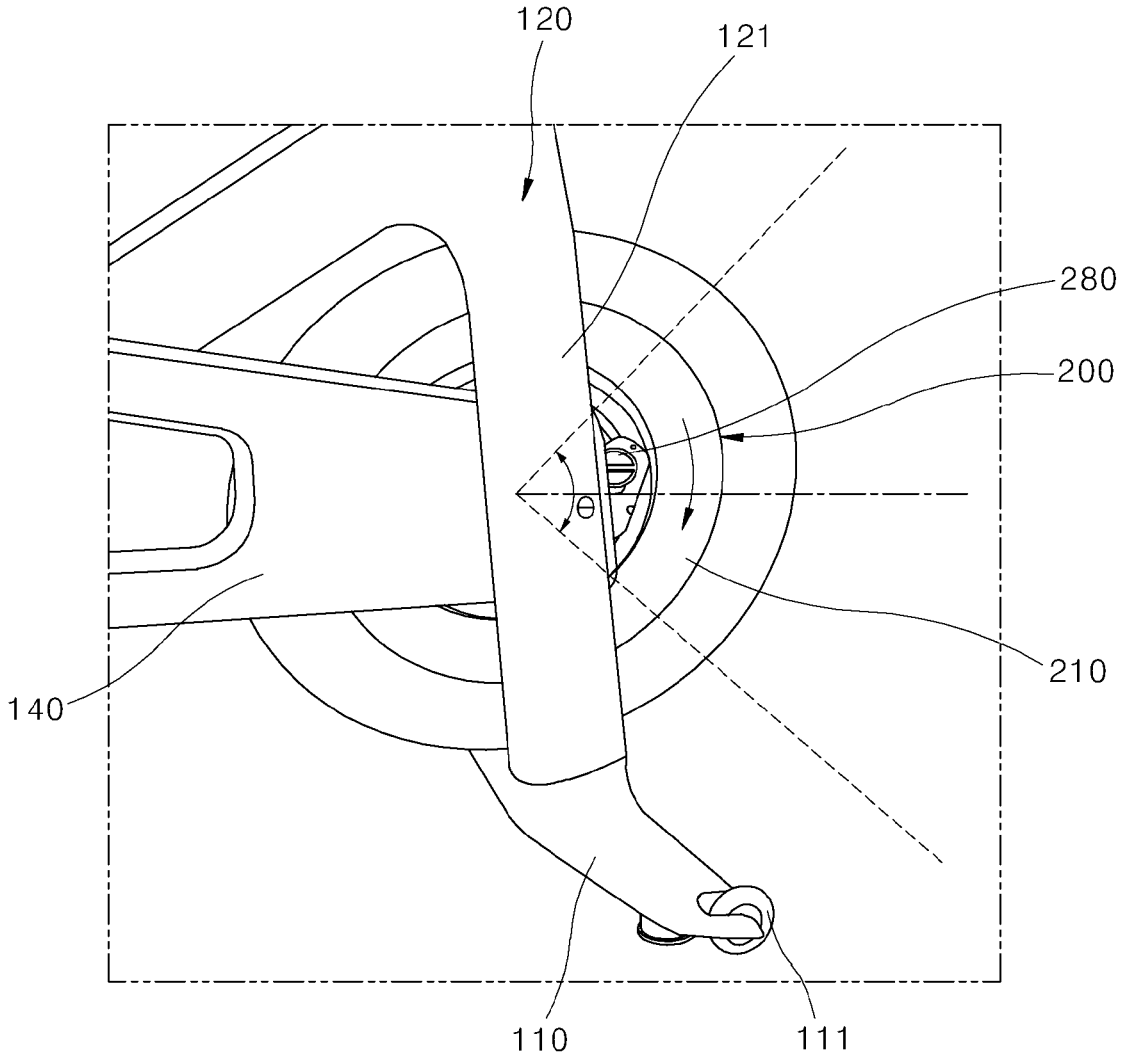

[Fig. 17]
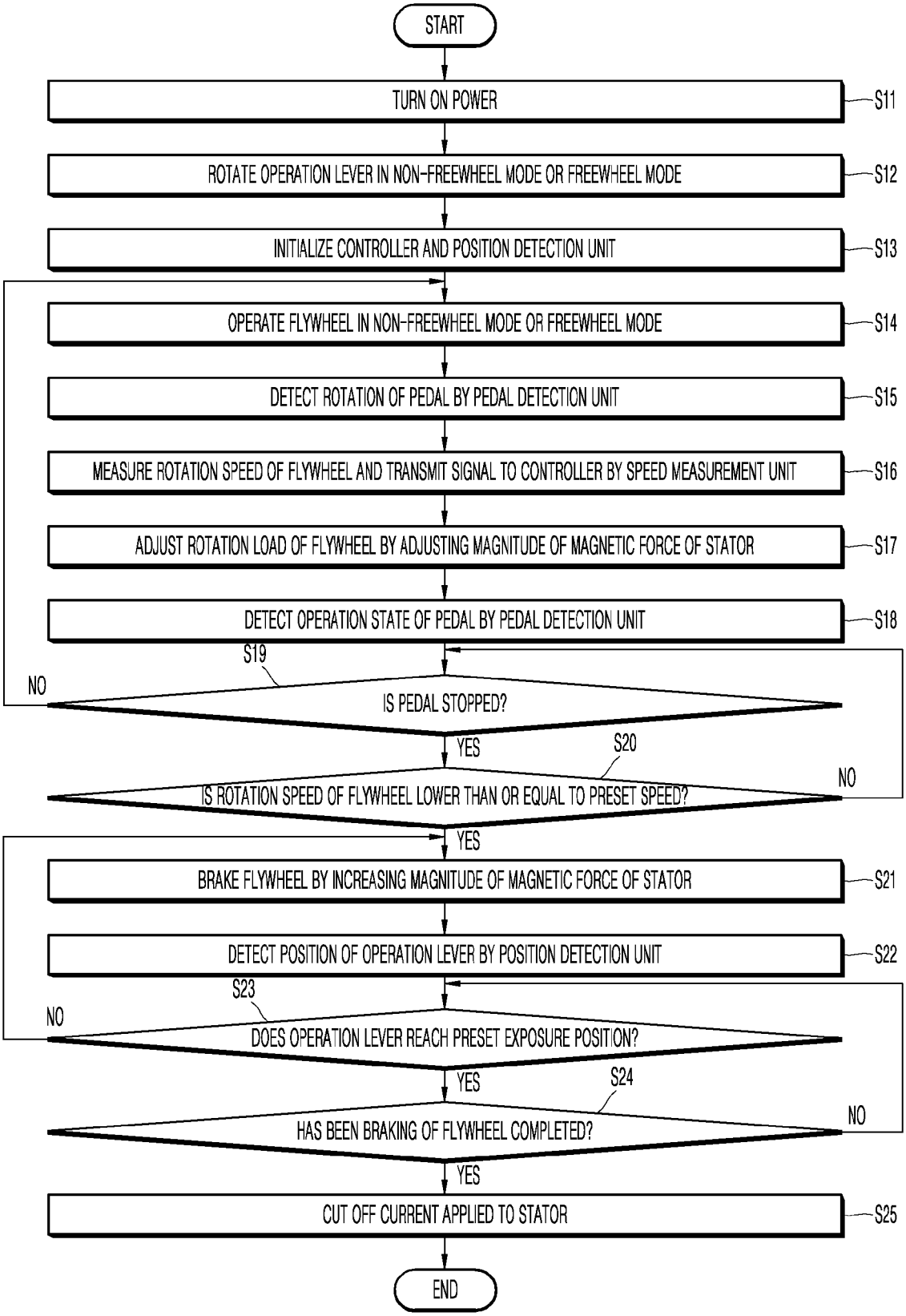

FITNESS BIKE AND CONTROLLING METHOD THEREOF

TECHNICAL FIELD

This application is the National Phase of PCT International Application No. PCT/KR2023/003536, filed on Mar. 16, 2023, which claims priority under 35 U.S.C. 119(a) to Patent Application No. 10-2022-0032477, filed in the Republic of Korea on Mar. 16 2022, all of which are hereby expressly incorporated by reference into the present application.

The present invention relates to a fitness bike and a method of controlling the same capable of automatically arranging an operation lever at an exposure position during braking of a flywheel and operating the operation lever without manually rotating the flywheel.

BACKGROUND ART

In general, fitness bikes are used as indoor exercise mechanism for strengthening muscle strength. Wheels of a fitness bike can be rotated by pedaling to perform exercise. The fitness bikes can be classified into spinning bikes capable of performing spinning exercise and indoor bikes in which wheels are rotated by rotating pedals in a forward direction like a bike.

Due to the characteristics of exercising by pedaling, a non-freewheel structure is applied to the spinning bikes, and the freewheel structure is applied to the indoor bikes.

In the non-freewheel structure applied to the spinning bikes, power is transmitted to the wheels in any case in which a pedal is rotated in forward and reverse directions to rotate the wheels.

In addition, in the freewheel structure applied to indoor bikes, when the pedal is rotated in the forward direction, power is transmitted to the wheels to rotate the wheels. However, when the pedal is stopped or rotated in the reverse direction, power is not transmitted to the wheels and the wheels are not rotated.

In Korean Patent No. 2304923 (registered on Sep. 24, 2021), an indoor fitness bike including an electronic brake is disclosed. When the indoor exercise bike is driven by a brake motor, a lead screw and a brake shoe are moved to brake wheels. However, the indoor fitness bikes cannot switch the wheels between a non-freewheel mode and a freewheel mode.

In addition, in Korean Patent Application Laid-Open No. 2007-0038634 (published on Apr. 11, 2007), a bike-type fitness mechanism is disclosed. Disclosed is a configuration in which as an electromagnetic field is generated in an interfering fluid accommodated in a housing, a brake unit of the bike-type fitness mechanism adjusts a load applied to a wheel member and brakes the wheel member. However, the bike-type fitness mechanism cannot switch the wheel member between the non-freewheel mode and the freewheel mode.

Technical Problem

The present invention has been made in efforts to solve the above-described problems and is directed to providing a fitness bike and a method of controlling the same capable of automatically arranging an operation lever at an exposure position during braking of a flywheel.

The present invention is directed to providing a fitness bike and a method of controlling the same capable of operation an operation lever without manually rotating a flywheel.

The present invention is directed to providing a fitness bike and a method of controlling the same capable of braking a flywheel by increasing a magnitude of a magnetic force of a stator step by step.

The present invention is directed to providing a fitness bike and a method of controlling the same capable of rotating a flywheel in any one of a non-freewheel mode and a freewheel mode.

DISCLOSURE OF INVENTION

Technical Problem

The present invention has been made in efforts to solve the above-described problems and is directed to providing a fitness bike and a method of controlling the same capable of automatically arranging an operation lever at an exposure position during braking of a flywheel.

The present invention is directed to providing a fitness bike and a method of controlling the same capable of operation an operation lever without manually rotating a flywheel.

The present invention is directed to providing a fitness bike and a method of controlling the same capable of braking a flywheel by increasing a magnitude of a magnetic force of a stator step by step.

The present invention is directed to providing a fitness bike and a method of controlling the same capable of rotating a flywheel in any one of a non-freewheel mode and a freewheel mode.

Solution to Problem

A fitness bike according to the present invention includes an operation lever configured to restrict a clutch gear unit to a flywheel to allow the flywheel to operate in a non-freewheel mode and release the restriction between the clutch gear unit and the flywheel to allow the flywheel to operate in a freewheel mode.

The fitness bike includes a position detection unit installed on the flywheel to detect a rotation position of the operation lever, and a controller configured to brake the flywheel by adjusting a magnitude of a magnetic force of a stator so that the operation lever stops at a preset exposure position when a pedal is stopped.

The clutch gear unit may include a rotating gear unit rotatably and axially coupled to a rotation center of the flywheel, and a latching gear unit configured to allow the flywheel to operate in the non-freewheel mode as the latching gear unit is engaged with the rotating gear unit and allow the flywheel to operate in the freewheel mode as the latching gear unit is separated from the rotating gear unit.

The clutch gear unit may further include a one-way bearing unit coupled between the rotating gear unit and the flywheel.

The one-way bearing unit may restrict the flywheel and the rotating gear unit to rotate the flywheel and the rotating gear unit together when the rotating gear unit rotates in a forward direction and release the restriction of the flywheel and the rotating gear unit to rotate only the rotating gear unit when the rotating gear unit rotates in a reverse direction.

The preset exposure position may be a position at which the operation lever may be visually identified at a front side of the frame unit.

The position detection unit may include two or more Hall sensors installed on the flywheel.

The fitness bike may further include a pedal detection unit installed on a driving shaft unit of the pedal to detect whether the pedal is rotated.

After the pedal is stopped, when a rotation speed of the flywheel detected by a speed measurement unit is lower than or equal to a preset speed, the controller may brake the flywheel by increasing the magnitude of the magnetic force of the stator.

The controller may decelerate the flywheel step by step to brake the flywheel by increasing the magnitude of the magnetic force of the stator step by step.

The fitness bike may further include a speed measurement unit installed on the flywheel to measure a rotation speed of the flywheel.

In the non-freewheel mode, when a pulley rotates in a forward direction and a reverse direction, a rotating gear unit, a latching gear unit, a wheel cover, and a wheel body unit may be all rotated.

In the freewheel mode, when the pulley rotates in the forward direction, the rotating gear unit, the latching gear unit, the wheel cover, and the wheel body unit may be all rotated, and when the pulley rotates in the reverse direction, the rotating gear unit may be rotated.

The stator may be fixed to the frame unit.

Advantageous Effects of Invention

According to the present invention, when a pedal is stopped, a controller adjusts a magnitude of a magnetic force of a stator to stop an operation lever at a preset exposure position, and thus a user can immediately operate the operation lever when starting the next exercise.

According to the present invention, since an operation lever is disposed at an exposure position during braking of a flywheel, a user does not need to manually rotate the flywheel to find the operation lever.

According to the present invention, when a pedal is stopped, a flywheel can be stopped by increasing a magnitude of a magnetic force of a stator step by step so that an operation lever stops at a preset exposure position. Therefore, it is possible to prevent sudden braking of the flywheel and prevent a sudden braking load from being applied to a clutch gear unit or the like.

According to the present invention, a flywheel can be operated in a non-freewheel mode as a latching gear unit is engaged with a rotating gear unit. In addition, the flywheel can be operated in a freewheel mode as the latching gear unit is separated from the rotating gear unit.

In addition to the above-described effects, specific effects of the present invention will be described together while describing specific items for carrying out the present invention.

BRIEF DESCRIPTION OF DRAWINGS

FIG. 1 is a perspective view schematically showing a fitness bike according to the present invention.

FIG. 2 is an exploded perspective view schematically showing a state in which a flywheel is disassembled from the fitness bike in FIG. 1.

FIG. 3 is a perspective view schematically showing the flywheel in the fitness bike in FIG. 2.

FIG. 4 is a cross-sectional view schematically showing the flywheel in the fitness bike in FIG. 2.

FIG. 5 is an exploded perspective view schematically showing the flywheel in FIG. 4.

FIG. 6 is an exploded perspective view schematically showing a coupling structure between a rotating gear unit and a pulley in a clutch gear unit of the flywheel in FIG. 5.

FIG. 7 is an exploded perspective view schematically showing a coupling structure between a latching gear unit and a wheel cover in the clutch gear unit of the flywheel in FIG. 5.

FIG. 8 is an exploded perspective view schematically showing a coupling structure of the wheel cover, the rotating gear unit, and a one-way bearing unit in the clutch gear unit in FIG. 5.

FIG. 9 is a perspective view schematically showing a coupling structure of the wheel cover, the rotating gear unit, and the pulley in the clutch gear unit in FIG. 5.

FIG. 10 is a perspective view schematically showing a coupling structure between the latching gear unit and the rotating gear unit in the clutch gear unit in FIG. 9.

FIG. 11 is a front view schematically showing a state in which the flywheel is rotated in a non-freewheel mode as the latching gear unit is engaged with the rotating gear unit in the clutch gear unit in FIG. 10.

FIG. 12 is a cross-sectional view schematically showing a state of transmitting power transmitted to the pulley in the non-freewheel mode in FIG. 11.

FIG. 13 is a front view schematically showing a state in which the flywheel is rotated in a freewheel mode as the latching gear unit is separated from the rotating gear unit in the clutch gear unit in FIG. 10.

FIG. 14 is a cross-sectional view schematically showing a state of transmitting power transmitted to the pulley in the freewheel mode in FIG. 13.

FIG. 15 is a block diagram schematically showing a configuration for controlling the fitness bike according to the present invention.

FIG. 16 is a front view schematically showing a state in which an operation lever stops at an exposure position during braking of the flywheel in the fitness bike according to the present invention.

FIG. 17 is a flowchart schematically showing a method of controlling the fitness bike according to the present invention.

DESCRIPTIONS OF REFERENCE NUMERALS

1: Fitness bike 110: Base unit
111: Leg unit 112: Roller
120: Frame unit 121: Fork unit
123: Spacer 124: Seat housing unit
125: Stem 126: Handle
127: Display unit 128: Seat post
129: Seat 130: Pedal
132: Driving shaft unit 140: Protective cover
200: Flywheel 210: Wheel body unit
211: Flange unit 212: Rim unit
213: Mounting unit 215: Fixed panel unit
216: Panel seating groove 217: Rotating hole
220: Wheel cover 221: Seating groove portion
222: Inner key groove 223: Guide groove
224: Connection hole 225: Gear fixing unit
225*a*: Fastening member 225*b*: Washer
227: Guide hole 230: Clutch gear unit
240: Rotating gear unit 241: Rotating shaft unit
242: Inner hole 243: Outer key groove

244: Outer planar portion 245: Shaft
246: Shaft bearing 247: Pulley
248: Circular gear unit 250: One-way bearing unit
251: Outer key groove 252: Second key member
253: Inner key groove 254: First key member
260: Latching gear unit 261: Connection groove
262: Restriction member 263: Latching through hole
264: Slide pin unit 264*a*: Restriction ring
265: Elastic member 270: Stator
271: Iron core 272: Coil
274: Inner plate 275: Outer plate
280: Operation lever 281: Operation rib
282: Boss unit 283: Boss latching unit
310: Controller 320: Position detection unit
330: Pedal detection unit 340: Speed measurement unit

MODE FOR THE INVENTION

Hereinafter, exemplary embodiments of the present invention will be described in detail with reference to the accompanying drawings.

The present invention is not limited to the embodiments disclosed below, but may have various changes and may be implemented in various different forms. Only the embodiment is provided to complete the disclosure of the present invention and fully inform those skilled in the art of the scope of the invention. Therefore, it should be understood that the present invention is not limited to the embodiments disclosed below, but includes not only the substitution or addition of a configuration of one embodiment and a configuration of another embodiment but also all changes, equivalents, and substitutes included in the technical spirit and scope of the present invention.

It should be understood that the accompanying drawings are only for easy understanding of the embodiments disclosed in the specification, the technical spirit disclosed in this specification is not limited by the accompanying drawings, and the accompanying drawings include all changes, equivalents, and substitutes included in the spirit and technical scope of the present invention. In the drawings, components may be exaggeratedly large or small in size or thickness in consideration of convenience of understanding or the like, but therefore, the scope of the present invention should not be construed as being limited.

Terms used herein are only used to describe specific implementations or embodiments and are not intended to limit the present invention. In addition, singular expressions include plural expressions unless the context clearly dictates otherwise. In the specification, terms such as "comprise" and "consist of" are intended to designate that features, numbers, steps, operations, components, units, or combinations thereof described in the specification are present. That is, in the specification, it should be understood that terms such as "comprises" and "consist of" do not preclude the possibility of presence or addition of one or more other features, numbers, steps, operations, components, units, or combinations thereof in advance.

Terms including ordinal numbers, such as first and second, may be used to describe various components, but the components are not limited by the terms. These terms are only used for the purpose of distinguishing one component from another.

It should be understood that when a certain component is described as being "connected" or "coupled" to another component, the certain component may be directly connected or coupled to another component, but other components may be present therebetween. On the other hand, it should be understood that when a certain component is described as being "directly connected" or "directly coupled" to another component, no other components are present therebetween.

It should be understood that when a certain component is described as being "above" or "under" another component, not only the certain component may be disposed just above another component but also other components may be present therebetween.

Unless defined otherwise, all terms used herein, including technical or scientific terms, have the same meaning as commonly understood by those skilled in the art to which the present invention pertains. Terms such as those defined in commonly used dictionaries should be construed as having a meaning consistent with the meaning in the context of the related art, and unless explicitly defined in the application, the terms are not construed as an ideal or excessively formal meaning.

Hereinafter, a fitness bike according to an embodiment of the present invention will be described.

FIG. 1 is a perspective view schematically showing a fitness bike according to the present invention, and FIG. 2 is an exploded perspective view schematically showing a state in which a flywheel is disassembled from the fitness bike in FIG. 1.

Referring to FIGS. 1 and 2, a fitness bike 1 according to an embodiment of the present invention brakes a flywheel 200 so that an operation lever 280 stops at a preset exposure position when exercise is stopped. Therefore, when a user restarts the exercise, the user may easily operate the operation lever 280 without manually rotating the flywheel 200.

The fitness bike 1 includes a frame unit 120. A base unit 110 is installed at a lower side of the frame unit 120 to support the frame unit 120. The base unit 110 may include a plurality of leg units 111 extending outward from both sides of the lower side of the frame unit 120. In addition, the base unit 110 may include a base plate (not shown) connected to the lower side of the frame unit 120. The base unit 110 may be formed in any of various shapes.

A roller 112 may be installed on the base unit 110 to move the fitness bike 1. The roller 112 may be installed at only any one of a front side and a rear side of the base unit 110. In addition, the roller 112 may be installed at both the front side and the rear side of the base unit 110.

A spacer 123 extends upward from a front side of the frame unit 120. A stem 125 is coupled to the spacer 123 having an adjustable height. A handle 126 is installed on the spacer 123 so that a user may exercise by holding the handle 126. In addition, a display unit 127 may be installed above the spacer 123 to output exercise information, such as a speed and a rotating load of the fitness bike 1. The display unit 127 may be installed above the stem 125 to be angularly adjusted or fixed.

A seat housing 124 extends upward from a rear side of the frame unit 120. A seat post 128 is coupled to the seat housing 124 to be adjusted in height. A seat 129 is installed above the seat post 128 so that the user may sit thereon.

Since the stem 125 and the seat post 128 are installed to be adjusted in height, the handle 126 and the seat 129 may be adjusted according to the user's physical condition or exercise style.

A pedal 130 is rotatably installed at the lower side of the frame unit 120. The pedal 130 is connected to both sides of a driving shaft unit 132. In addition, a pulley 247 is rotatably installed below the frame unit 120. The driving shaft unit 132 and the pulley 247 are connected by a power transmission unit (not shown) such as a belt or a chain. Therefore, when the user steps on the pedal 130, the flywheel 200 may be rotated as a driving force of the pedal 130 is transmitted to a clutch gear unit 230 through the power transmission unit.

Protective covers 140 are installed at both sides of the frame unit 120 to shield the driving shaft unit 132, the clutch gear unit 230, and the power transmission unit from the outside. The protective cover 140 is coupled to both sides of the frame unit 120. The protective cover 140 is disposed at the lower side of the frame unit 120 to extend in a front-rear direction.

The fitness bike 1 according to the present invention may have the pedal 130 disposed at the lower rear side of the frame unit 120 and the flywheel 200 disposed at the lower front side of the frame unit 120. In addition, the pedal 130 may be disposed at the lower front side of the frame unit 120, and the flywheel 200 may be disposed at the lower rear side of the frame unit 120. As front and rear positions of the pedal 130 and the flywheel 200 are changed, a shape and structure of the frame unit 120 may be changed. Hereinafter, one example of a case in which the flywheel 200 is disposed at the front side of the frame unit 120 will be described.

FIG. 3 is a perspective view schematically showing the flywheel in the fitness bike in FIG. 2, FIG. 4 is a cross-sectional view schematically showing the flywheel in the fitness bike in FIG. 2, FIG. 5 is an exploded perspective view schematically showing the flywheel in FIG. 4, FIG. 6 is an exploded perspective view schematically showing a coupling structure between a rotating gear unit and a pulley in a clutch gear unit of the flywheel in FIG. 5, FIG. 7 is an exploded perspective view schematically showing a coupling structure between a latching gear unit and a wheel cover in the clutch gear unit of the flywheel in FIG. 5, FIG. 8 is an exploded perspective view schematically showing a coupling structure of the wheel cover, the rotating gear unit, and a one-way bearing unit in the clutch gear unit in FIG. 5, and FIG. 9 is a perspective view schematically showing a coupling structure of the wheel cover, the rotating gear unit, and the pulley in the clutch gear unit in FIG. 5.

Referring to FIGS. 3 to 9, the flywheel 200 is rotatably installed on the frame unit 120. The flywheel 200 may be entirely formed in a circular shape.

The clutch gear unit 230 is rotatably and axially coupled to the flywheel 200. The clutch gear unit 230 is installed to be concentric with the flywheel 200. The clutch gear unit 230 is installed to pass through a rotation center of the flywheel 200. A shaft 245 is fitted into the clutch gear unit 230. Both sides of the shaft 245 are coupled to a fork unit 121 of the frame unit 120 not to rotate. The clutch gear unit 230 is installed to be concentric with the shaft 245. The pulley 247 is coupled to the clutch gear unit 230 so that the power transmission unit, such as a belt or a chain is connected to the clutch gear unit 230. Therefore, when the clutch gear unit 230 is rotated by the power transmission unit, the shaft 245 is not rotated.

A stator 270 adjusts a rotating load of the flywheel 200 by applying a magnetic force to the flywheel 200. The stator 270 may be an electromagnet in which a coil 272 is wound around an iron core 271. As power is applied to the coil 272, a magnetic force is generated in the stator 270. A magnitude of the magnetic force of the stator 270 may be adjusted by adjusting a current applied to the coil 272 of the stator 270. As the rotating load of the flywheel 200 (magnitude of the magnetic force of the stator 270) increases, a pedal force applied on the pedal 130 increases, and as the rotating load of the flywheel 200 (magnitude of the magnetic force of the stator 270) is reduced, the pedal force applied on the pedal 130 is reduced. As described above, the user's pedal force may be adjusted by adjusting the rotating load of the flywheel 200 by the adjustment of the magnitude of the magnetic force of the stator 270.

An inner plate 274 may be stacked on an inner surface of the stator 270, and an outer plate 275 may be stacked on an outer surface of the stator 270. A recess (not shown) having a shape corresponding to a seating groove portion 221 may be formed at the center of the inner plate 274 so that the seating groove portion 221 of a wheel cover 220 is fitted. The recess is rotatably fitted into a rotating shaft unit 241 of the clutch gear unit 230. The outer plate 275 may be formed in a disk shape to entirely shield the outer surface of the stator 270.

The operation lever 280 is rotatably installed on the flywheel 200 and connected to the clutch gear unit 230. The operation lever 280 is installed on the outer surface of the flywheel 200 to rotate in a predetermined angle range. The operation lever 280 is installed to be exposed on the outer surface of the flywheel 200. The operation lever 280 restricts the clutch gear unit 230 to the flywheel 200 to allow the flywheel 200 to operate in a non-freewheel mode and releases the clutch gear unit 230 from the flywheel 200 to allow the flywheel 200 to operate in a freewheel mode.

The non-freewheel mode is an operation mode in which the flywheel 200 rotates when the pulley 247 and the clutch gear unit 230 rotate in a forward direction or rotate in a reverse direction. In the non-freewheel mode, the clutch gear unit 230 and the flywheel 200 are interlocked to rotate together.

The freewheel mode is an operation mode in which, when the clutch gear unit 230 rotates in the forward direction and when the clutch gear unit 230 rotates in the forward direction and then stops, the flywheel 200 rotates, and when the clutch gear unit 230 rotates in the reverse direction, the flywheel 200 does not rotate. In the freewheel mode, when the clutch gear unit 230 rotates in the reverse direction, the flywheel 200 does not rotate as the clutch gear unit 230 idles in the flywheel 200.

A position detection unit 320 is installed on the flywheel 200 to detect a rotating position of the operation lever 280. The position detection unit 320 detects a position signal of the operation lever 280 and is electrically connected to a controller 310 to transmit the position signal to the controller 310.

When the pedal 130 is stopped, the controller 310 brakes the flywheel 200 by adjusting the magnitude of the magnetic force of the stator 270 so that the operation lever 280 stops at the preset exposure position. That is, when the rotation speed of the flywheel 200 is reduced to a preset speed or lower in a state in which the user's pedal force is not applied to the pedal 130, the controller 310 brakes the flywheel 200 by increasing the magnitude of the magnetic force of the stator 270.

At this time, in the controller 310, the magnitude of the magnetic force of the stator 270 is preset to respond to the preset rotation speed of the flywheel 200. Therefore, when the flywheel 200 reaches the preset rotation speed after the pedal 130 is stopped, the stator 270 brakes the flywheel 200 by applying a preset magnitude of the magnetic force, and the operation lever 280 stops at the preset exposure position.

The preset rotation speed of the flywheel 200 and the preset strength of the magnetic force of the stator 270 may be variously changed depending on a weight of the flywheel 200, a diameter of the flywheel 200, and a capacity of the stator 270. For example, when the load of the flywheel 200 and the diameter of the flywheel 200 are large, the preset rotation speed of the flywheel 200 may be set to a relatively low speed. In addition, the preset magnitude of the magnetic force of the stator 270 may be set to be relatively large. On the other hand, when the load of the flywheel 200 and the diameter of the flywheel 200 are small, the preset rotating speed of the flywheel 200 may be set to a relatively high speed. In addition, the preset magnitude of the magnetic force of the stator 270 may be set to be relatively small.

As described above, since the controller 310 adjusts the magnitude of the magnetic force of the stator 270 to stop the operation lever 280 at the preset exposure position when the pedal 130 is stopped, the user may operate the operation lever 280 immediately when starting the next exercise. In addition, the user does not have to manually rotate the flywheel 200 to find the operation lever 280. Therefore, the user may easily and quickly operate the fitness bike 1 in the non-freewheel mode and the freewheel mode.

In addition, when the pedal 130 is stopped, the controller 310 may brake the flywheel 200 by increasing the magnitude of the magnetic force of the stator 270 step by step so that the operation lever 280 stops at the preset exposure position. Therefore, since the flywheel 200 is braked while decelerating step by step, it is possible to prevent the flywheel 200 from being suddenly braked and prevent a sudden braking load from being applied to the clutch gear unit 230 or the like.

The flywheel 200 includes a wheel body unit 210 and the wheel cover 220.

The wheel cover 220 is installed inside the wheel body unit 210. A circular gear unit 248 of the clutch gear unit 230 is disposed inside the wheel body unit 210 and the wheel cover 220. The clutch gear unit 230 is installed to pass through the centers of the wheel body unit 210 and the wheel cover 220.

A flange unit 211 is formed on a circumferential portion of the wheel body unit 210 in a circumferential direction. The flange unit 211 is formed parallel to an axial direction of the clutch gear unit 230. The flange unit 211 is formed in an annular shape to surround an outer circumference of the wheel body unit 210. A rim unit 212 is formed on the outer circumferential surface of the flange unit 211 to be perpendicular to or substantially perpendicular to the flange unit 211. The rim unit 212 may be formed in an annular shape in the circumferential direction of the flange unit 211.

The wheel cover 220 is disposed inside the flange unit 211. The wheel cover 220 may be entirely formed in a disk shape. The seating groove portion 221 protruding to an opposite side of the wheel body unit 210 is formed at the center of the wheel cover 220. The seating groove portion 221 is formed in an annular shape.

The clutch gear unit 230 includes a rotating gear unit 240, a one-way bearing unit 250, and a latching gear unit 260.

The rotating gear unit 240 is rotatably and axially coupled to the rotation center of the flywheel 200. The rotating gear unit 240 includes the rotating shaft unit 241 and the circular gear unit 248 formed on an outer circumferential surface of the rotating shaft unit 241. The rotating shaft unit 241 is installed to pass through the wheel body unit 210 and the wheel cover 220. The shaft 245 is rotatably installed at a center of the rotating shaft unit 241. A shaft bearing 246 is installed between the rotating shaft unit 241 and the shaft 245. The pulley 247 is coupled to one side of the rotating shaft unit 241. The pulley 247 is coupled to the rotating shaft unit 241 to be concentric with the rotating shaft unit 241 and connected to the power transmission unit. The pulley 247 rotates together with the rotating shaft unit 241, and the shaft 245 is fastened to the fork unit 121 of the frame unit 120 not to be rotated. The circular gear unit 248 is disposed between the wheel body unit 210 and the wheel cover 220. The circular gear unit 248 is formed in the form of an external gear. The circular gear unit 248 is formed to be concentric with the rotating shaft unit 241.

The one-way bearing unit 250 is coupled between the rotating gear unit 240 and the flywheel 200. The one-way bearing unit 250 restricts the flywheel 200 and the rotating gear unit 240 so that the flywheel 200 and the rotating gear unit 240 rotate together when the rotating gear unit 240 rotates in the forward direction and releases the restriction of the flywheel 200 and the rotating gear unit 240 so that only the rotating gear unit 240 rotates when the rotating gear unit 240 rotates in the reverse direction.

The one-way bearing unit 250 is formed in a structure in which a bearing (not shown) is interposed between an inner ring (not shown) and an outer ring (not shown). In the one-way bearing unit 250, the bearing restricts the inner ring and the outer ring when rotating in one direction and releases the restriction between the inner ring and the outer ring when rotating in the other direction. The bearing may be applied in any of various shapes, such as a spherical shape and a circular bar shape. The one-way bearing unit 250 may be applied in any of various shapes as long as it rotates the flywheel 200 when the rotating shaft unit 241 rotates in the forward direction.

The latching gear unit 260 is connected to the operation lever 280 to be rotated by the operation lever 280. The latching gear unit 260 is rotatably installed at a position radially spaced a predetermined distance from a shaft center of the rotating gear unit 240. The latching gear unit 260 is installed to be rotated by the operation lever 280 within a predetermined angle range. The latching gear unit 260 allows the flywheel 200 to operate in the non-freewheel mode as the latching gear unit 260 is engaged with the rotating gear unit 240 and allows the flywheel 200 to operate in the freewheel mode as the latching gear unit 260 is separated from the rotating gear unit 240.

FIG. 11 is a front view schematically showing a state in which the flywheel is rotated in the non-freewheel mode as the latching gear unit is engaged with the rotating gear unit in the clutch gear unit in FIG. 10, FIG. 12 is a cross-sectional view schematically showing a state of transmitting power transmitted to the pulley in the non-freewheel mode in FIG. 11, FIG. 13 is a front view schematically showing a state in which the flywheel is rotated in the freewheel mode as the latching gear unit is separated from the rotating gear unit in the clutch gear unit in FIG. 10, FIG. 14 is a cross-sectional view schematically showing a state of transmitting power transmitted to the pulley in the freewheel mode in FIG. 13, FIG. 15 is a block diagram schematically showing a configuration for controlling the fitness bike according to the present invention, and FIG. 16 is a front view schematically showing a state in which the operation lever stops at the exposure position during braking of the flywheel in the fitness bike according to the present invention.

Referring to FIGS. 11 to 14, in the non-freewheel mode, the latching gear unit 260 is rotated to be engaged with the rotating gear unit 240. Therefore, when the pulley 247 rotates in the forward direction and the reverse direction, the rotating gear unit 240, the latching gear unit 260, the wheel cover 220, and the wheel body unit 210 are all rotated (see FIGS. 11 and 12).

In the freewheel mode, the latching gear unit 260 is rotated to be separated from the rotating gear unit 240. Therefore, since the one-way bearing unit 250 restricts the rotating gear unit 240 and the wheel cover 220 when the pulley 247 rotates in the forward direction, the rotating gear unit 240, the latching gear unit 260, the wheel cover 220, and the wheel body unit 210 are all rotated in the forward direction. On the other hand, since the one-way bearing unit 250 releases the restriction between the rotating gear unit 240 and the wheel cover 220 when the pulley 247 rotates in the reverse direction or stops, the rotating gear unit 240 rotates in the reverse direction. On the other hand, when the pulley 247 rotates in the reverse direction, the latching gear unit 260, the wheel cover 220, and the wheel body unit 210 maintain a stopped state (see FIGS. 13 and 14).

In addition, since the stator 270 is fixed to the frame unit 120, the stator 270 always does not rotate in the non-freewheel mode and the freewheel mode.

A rotating shaft bearing 241*a* is installed between the rotating shaft unit 241 and the wheel body unit 210. The one-way bearing unit 250 is installed between the rotating shaft unit 241 and the wheel cover 220. The one-way bearing unit 250 is installed in the seating groove portion 221 of the wheel cover 220. A stator bearing 277 is installed between the rotating shaft unit 241 and the stator 270.

A mounting unit 213 is installed at a portion radially spaced a predetermined distance from the rotation center of the wheel body unit 210, and a fixed panel unit 215 is installed at the mounting unit 213 (see FIG. 7). A panel seating groove 216 is formed in the fixed panel unit 215 so that the operation lever 280 is seated thereon, and a rotating hole 217 is formed at a center of the panel seating groove 216.

An operation rib 281 is formed to protrude outward from the operation lever 280. A boss unit 282 may be formed to protrude from a center of the operation lever 280, and a boss latching unit 283 may be formed on the boss unit 282. The boss latching unit 283 may be formed in a planar shape.

A connection groove 261 is formed at one side of the latching gear unit 260 so that the boss unit 282 is inserted into and restricted by the latching gear unit 260. A guide groove 223 is formed in the wheel cover 220 so that the fixed panel unit 215 is seated thereon. A connection hole 224 is formed in the guide groove 223 so that the boss unit 282 passes through the guide groove 223. In addition, a guide hole 227 is formed in the guide groove 223 so that a slide pin unit 264 of the latching gear unit 260 is movably inserted into the guide groove 223. The guide hole 227 may be formed in an arc shape. The guide hole 227 limits a moving distance of the slide pin unit 264. In addition, a gear fixing unit 225 is formed in the connection hole 224 to be fastened to the boss unit 282 of the operation lever 280. The gear fixing unit 225 may include a fastening member 225*a* and a washer 225*b* fastened to the boss unit 282.

A restriction member 262 may be installed at the other side (upper side) of the latching gear unit 260 to be coupled to the latching gear unit 260 to restrict the slide pin unit 264 (see FIG. 7). Latching through holes 263 are formed in the restriction member 262 and the latching gear unit 260 so that the slide pin unit 264 passes through the restriction member 262 and the latching gear unit 260, and stepped portions (not shown) are formed at both sides of the latching through hole 263 to restrict both sides of an elastic member 265 fitted into the slide pin unit 264 in a longitudinal direction. A restriction ring 264*a* is formed on an outer circumferential surface of the slide pin unit 264.

An inner hole 242 is formed in the rotating shaft unit 241 of the rotating gear unit 240, and an outer key groove 243 is formed in an outer circumferential surface of one side of the rotating shaft unit 241. In addition, an outer planar portion 244 is formed at the other side of the rotating shaft unit 241, and an inner planar portion 247*a* is formed at an inner side of the pulley 247 to be opposite to the outer planar portion 244. Since the inner planar portion 247*a* and the outer planar portion 244 are in surface contact with each other when the pulley 247 is fitted into the rotating shaft unit 241, the pulley 247 is restricted by the rotating shaft unit 241 not to rotate alone.

An inner key groove 222 is formed in the seating groove portion 221 of the wheel cover 220, and an outer key groove 251 of the one-way bearing unit 250 is formed on an outer circumferential surface of the one-way bearing unit 250 to correspond to the inner key groove 222 of the seating groove portion 221 (see FIG. 8). After the one-way bearing unit 250 is seated in the seating groove portion 221, as a second key member 252 is inserted into the inner key groove 253 and the outer key groove 251 of the one-way bearing unit 250, the outer ring of the one-way bearing unit 250 is restricted by the seating groove portion 221 not to be rotated. In addition, the outer key groove 251 may be formed in the outer circumferential surface of the rotating shaft unit 241 of the rotating gear unit 240, and the inner key groove 253 may be formed in an inner circumferential surface of the one-way bearing unit 250. After the one-way bearing unit 250 is inserted into the rotating shaft unit 241, as a first key member 254 is inserted into the inner key groove 253 and the outer key groove 251, the inner ring of the one-way bearing unit 250 is restricted by the rotating shaft unit 241 not to be rotated.

The preset exposure position of the operation lever 280 may be a position at which the operation lever 280 may be visually identified at the front side of the frame unit 120 (see FIG. 16). The preset exposure position may be a region which avoids the frame unit 120 and the protective cover 140 at the front side of the frame unit 120. For example, The preset exposure position may be positioned within each angle range of 45° upward and downward with respect to a horizontal line segment drawn at the center of the rotating shaft unit 241, that is, the total angle range θ of 90° (see FIG. 16).

Therefore, since the operation lever 280 is disposed at a visually visible position on the flywheel 200, the user may more easily find and operate the operation lever 280.

The position detection unit 320 may include at least two Hall sensors installed on the flywheel 200 (see FIG. 15). The Hall sensor may include an optical sensor (not shown) installed on the flywheel 200 and a magnet (not shown) installed on a rotation trajectory of the optical sensor. Since the position detection unit 320 is formed of two or more Hall sensors, a rotation angle of the flywheel 200 may be accurately detected when the flywheel 200 rotates. Therefore, the position detection unit 320 may accurately detect the position of the operation lever 280 by detecting the rotation angle of the flywheel 200. By calculating the position of the operation lever 280 detected by the position detection unit 320 to control a current applied to the stator 270, the controller 310 may accurately brake the flywheel 200 so that the operation lever 280 is positioned at the preset exposure position.

The fitness bike 1 further includes a pedal detection unit 330 installed on the driving shaft unit 132 of the pedal 130 to measure whether the pedal 130 rotates. The pedal detection unit 330 may be a pressure sensor installed on the driving shaft unit 132 to measure a pressure applied to the pedal 130. In addition, the pedal detection unit 330 may be an encoder installed on the driving shaft unit 132 to detect the rotation of a driving unit. The pedal detection unit 330 is electrically connected to the controller 310. The pedal detection unit 330 detects the pressure or rotation of the pedal 130 and transmits a detected signal to the controller 310. The controller 310 may detect whether the pedal 130 is rotated by the signal received from the pedal detection unit 330.

The fitness bike 1 may further include a speed measurement unit 340 installed on the flywheel 200 to detect the rotation speed of the flywheel 200. The speed measurement unit 340 is electrically connected to the controller 310. As the speed measurement unit 340, an infrared ray sensor for measuring a speed by radiating infrared rays to the flywheel 200 may be applied. In addition, the speed measurement unit 340 may be an encoder installed on the shaft 245 or the rotating gear unit 240 to measure the rotation speed of the flywheel 200. Various types, such as a non-contact sensor and a contact sensor, may be applied to the speed measurement unit 340.

The speed measurement unit 340 transmits a signal about the rotation speed of the flywheel 200 to the controller 310. When it is determined that the rotation speed of the flywheel 200 is less than the preset speed after the pedal 130 is stopped, the controller 310 may brake the flywheel 200 by applying a current to the stator 270. In such a braking mode, by maximally applying the current to the stator 270, the controller 310 may brake the flywheel 200 so that the operation lever 280 is positioned at the preset exposure position.

A method of controlling the fitness bike according to the present invention configured as described above will be described.

FIG. 16 is a front view schematically showing a state in which the operation lever stops at the exposure position during braking of the flywheel in the fitness bike according to the present invention, and FIG. 17 is a flowchart schematically showing a method of controlling the fitness bike according to the present invention.

Referring to FIGS. 16 and 17, when the user presses a power button, the fitness bike 1 is turned on (S11). At this time, a current is applied to the controller 310, the position detection unit 320, the speed measurement unit 340, and the stator 270.

The user rotates the operation lever 280 in the non-freewheel mode or the freewheel mode (S12). At this time, the non-freewheel mode is selected when the operation lever 280 rotates in one direction, and the freewheel mode is selected when the operation lever 280 rotates in the other direction.

The controller 310 and the position detection unit 320 are initialized (S13). At this time, the position of the operation lever 280 in the current state is initialized.

When the user steps on the pedal 130, the flywheel 200 is rotated in the non-freewheel mode or the freewheel mode (S14).

In the non-freewheel mode, the latching gear unit 260 is engaged with the rotating gear unit 240. Therefore, when the pulley 247 rotates in the forward direction and reverse direction, the rotating gear unit 240, the latching gear unit 260, the wheel cover 220, and the wheel body unit 210 are all rotated.

In the freewheel mode, the latching gear unit 260 is separated from the rotating gear unit 240. Therefore, since the one-way bearing unit 250 restricts the rotating gear unit 240 and the wheel cover 220 when the pulley 247 rotates in the forward direction, the rotating gear unit 240 and the latching gear unit 260, the wheel cover 220, and the wheel body unit 210 are all rotated. On the other hand, since the one-way bearing unit 250 releases the restriction between the rotating gear unit 240 and the wheel cover 220 when the pulley 247 rotates in the reverse direction, the rotating gear unit 240 is rotated. Meanwhile, the latching gear unit 260, the wheel cover 220, and the wheel body unit 210 maintain a stopped state.

The pedal detection unit 330 detects the rotation of the pedal 130 (S15). At this time, the pedal detection unit 330 may measure a pressure applied to the driving shaft unit 132 by the pedal force applied on the pedal 130 or the number of rotations of the pedal 130. The pedal detection unit 330 transmits a rotation signal of the pedal 130 to the controller 310. When receiving the rotation signal of the pedal 130, the controller 310 determines that the user is exercising while stepping on the pedal 130.

The speed measurement unit 340 measures the rotation speed of the flywheel 200 and transmits a signal to the controller 310 (S16). The controller 310 determines that the flywheel 200 rotates after receiving the rotation signal transmitted from the speed measurement unit 340.

The rotation load of the flywheel 200 is adjusted by adjusting the magnitude of the magnetic force of the stator 270 (S17). At this time, when it is determined that the rotation speed of the flywheel 200 is the preset speed (e.g., 20 to 30 RPM) or higher, the controller 310 adjusts the rotation load of the flywheel 200 to increase or decrease the pedal force applied on the pedal 130. Therefore, the user may feel the same exercising feeling as when traveling on an uphill road or a downhill road.

The pedal detection unit 330 continuously detects an operation state of the pedal 130 (S18). At this time, when the pressure of the pedal 130 or the number of rotations of the pedal 130 is not detected by the pedal detection unit 330, the controller 310 may determine that the pedal 130 is stopped.

The controller 310 determines whether the pedal 130 is stopped (S19). At this time, the speed measurement unit 340 may continuously measure the rotation speed of the flywheel 200. In addition, the position detection unit 320 may continuously detect the position of the operation lever 280. In addition, when the pedal 130 is stopped, the controller 310 may increase an amount of current applied to the stator 270 step by step to reduce the rotation speed of the flywheel 200 step by step.

The controller 310 determines whether the rotation speed of the flywheel 200 is lower than or equal to the preset speed based on the signal received from the speed measurement unit 340 (S20). For example, the controller 310 may determine whether the flywheel 200 rotates at a preset speed of about 10 RPM. Here, the preset speed may be preset in a range of 5 to 15 RPM in consideration of a weight of the flywheel 200, a diameter of the flywheel 200, and the like.

The flywheel 200 is braked by increasing the magnetic force of the stator 270 (S21). At this time, the controller 310 may brake the flywheel 200 by maximally increasing the magnetic force of the stator 270 and maximally increasing the current applied to the stator 270. A maximum magnitude of the magnetic force of the stator 270 may be variously preset in the controller 310 according to a capacity of the stator 270 and the weight and diameter of the flywheel 200.

In addition, when the pedal 130 is stopped, the controller 310 may brake the flywheel 200 by increasing the magnitude of the magnetic force of the stator 270 step by step so that the operation lever 280 stops at the preset exposure position. Therefore, since the flywheel 200 is braked while decelerating step by step, it is possible to prevent the flywheel 200 from being suddenly braked and prevent a sudden braking load from being applied to the clutch gear unit 230 or the like.

The position detection unit 320 detects the position of the operation lever 280 (S22). The position detection unit 320 detects a specific position of the operation lever 280 at a specific rotation time point of the flywheel 200. The position detection unit 320 transmits a signal about the detected position of the operation lever 280 to the controller 310. The controller 310 may finely adjust the magnitude of the current applied to the stator 270 to correspond to the received position signal of the operation lever 280.

The position detection unit 320 continuously detects the position of the operation lever 280 to determine whether the operation lever 280 has reached the preset exposure position (S23). The controller 310 calculates a rotation angle of the flywheel 200 to determine whether the operation lever 280 has been positioned at the exposure position.

The controller 310 determines whether the braking of the flywheel 200 has been completed (S24). At this time, the controller 310 determines whether the flywheel 200 has been stopped by the signal received from the speed measurement unit 340.

The controller 310 cuts off the current applied to the stator 270 (S25). That is, when it is determined that the braking of the flywheel 200 has been completed in a state in which the operation lever 280 is positioned at the exposure position, the controller 310 cuts off the supply of the current to the stator 270. Therefore, the operation lever 280 may maintain the state of being exposed to the outside from the flywheel 200.

As described above, since the controller 310 adjusts the magnitude of the magnetic force of the stator 270 to stop the operation lever 280 at the preset exposure position when the pedal 130 is stopped, the user may operate the operation lever 280 immediately when starting the next exercise. In addition, the user does not have to manually rotate the flywheel 200 to find the operation lever 280. Therefore, the user can easily and quickly operate the fitness bike 1 in the non-freewheel mode and the freewheel mode.

Although the present invention has been described above with reference to exemplary drawings, it is apparent that the present invention is not limited by the embodiments and drawings disclosed in the specification, and various modifications are made by those skilled in the art without departing from the scope of the technical spirit of the present invention. In addition, although the operations and effects according to the configuration of the present invention have not been explicitly described and explained while describing the embodiments of the present invention, it goes without saying that the effects predictable by the corresponding configuration should also be acknowledged.

The invention claimed is:

1. A fitness bike comprising:

a pedal rotatably installed on a frame unit;

a flywheel installed on the frame unit and rotatable by the pedal;

a clutch gear unit rotatably and axially coupled to the flywheel;

a stator configured to apply a magnetic force to the flywheel to adjust a rotation load of the flywheel;

an operation lever rotatably installed on an outer surface of the flywheel, connected to the clutch gear unit to operate the clutch gear unit, and configured to restrict the clutch gear unit to the flywheel to allow the flywheel to operate in a non-freewheel mode and release the restriction between the clutch gear unit and the flywheel to allow the flywheel to operate in a freewheel mode;

a plurality of position sensors installed on the flywheel and configured to detect a rotation position of the operation lever; and a controller configured to receive the detected rotation position of the operation lever from the plurality of position sensors and adjust a magnitude of the magnetic force of the stator to brake and stop the flywheel, wherein, when the pedal is stopped and based on the detected rotation position of the operation lever, the controller adjusts the magnitude of the magnetic force of the stator to brake and stop the flywheel such that when the flywheel is stopped, the operation lever is at a preset exposure position.

2. The fitness bike of claim 1, further comprising a pedal sensor installed on a driving shaft unit of the pedal and configured to detect whether the pedal is rotated.

3. The fitness bike of claim 2, further comprising a speed sensor installed on the flywheel and configured to detect a rotation speed of the flywheel and transmit the detected rotation speed to the controller, wherein after the pedal is stopped and based on the detected rotation speed of the flywheel being lower than or equal to a preset speed, the controller increases the magnitude of the magnetic force of the stator to brake and stop the flywheel.

4. The fitness bike of claim 3, wherein increasing the magnitude of the magnetic force of the stator to brake and stop the flywheel comprises increasing the magnitude of the magnetic force of the stator step by step to reduce the rotation speed of the flywheel step by step.

5. The fitness bike of claim 1, further comprising a pulley rotatably installed on the frame unit and coupled to the clutch gear unit, wherein the flywheel includes a wheel body unit, and a wheel cover installed inside the wheel body unit, wherein the clutch gear unit includes a rotating gear unit coupled to the pulley to rotate together with the pulley, and a latching gear unit connected to the operation lever and rotated by the operation lever to be engaged with or separated from the rotating gear unit, and wherein, in the non-freewheel mode, the latching gear unit is engaged with the rotating gear unit such that when the pulley rotates in a forward direction and a reverse direction, the rotating gear unit, the latching gear unit, the wheel cover, and the wheel body unit are all rotated.

6. The fitness bike of claim 5, wherein, in the freewheel mode, the latching gear unit is separated from the rotating gear unit such that when the pulley rotates in the forward direction, the rotating gear unit, the latching gear unit, the wheel cover, and the wheel body unit are all rotated, and when the pulley rotates in the reverse direction, only the rotating gear unit is rotated.

7. The fitness bike of claim 1, wherein the clutch gear unit includes:

a rotating gear unit rotatably and axially coupled to a rotation center of the flywheel;

a one-way bearing unit coupled between the rotating gear unit and the flywheel, and configured to restrict the flywheel and the rotating gear unit to rotate the flywheel and the rotating gear unit together when the rotating gear unit rotates in a forward direction and release the restriction of the flywheel and the rotating gear unit to rotate only the rotating gear unit when the rotating gear unit rotates in a reverse direction; and a latching gear unit connected to the operation lever to be rotated by the operation lever, and configured to allow the flywheel to operate in the non-freewheel mode as the latching gear unit is engaged with the rotating gear unit and allow the flywheel to operate in the freewheel mode as the latching gear unit is separated from the rotating gear unit.

8. The fitness bike of claim 1, wherein the preset exposure position is a position at which the operation lever is visually identifiable at a front side of the frame unit.

9. The fitness bike of claim 1, wherein the plurality of position sensors includes-two or more Hall sensors installed on the flywheel.

10. The fitness bike of claim 1, further comprising a speed sensor installed on the flywheel and configured to measure a rotation speed of the flywheel.

11. The fitness bike of claim 1, wherein the stator is fixed to the frame unit.

12. A method of controlling a fitness bike including a pedal rotatably installed on a frame unit, a flywheel installed on the frame unit and rotatable by the pedal, a clutch gear unit rotatably and axially coupled to the flywheel, a stator configured to apply a magnetic force to the flywheel, an operation lever rotatably installed on an outer surface of the flywheel and connected to the clutch gear unit, a plurality of position sensors installed on the flywheel and configured to detect a rotation position of the operation lever, and a controller communicating with the plurality of position sensors and the stator, the method comprising:

selecting, by operating the operation lever, one of a non-freewheel mode and a freewheel mode as operation mode of the flywheel;

operating the flywheel in the selected operation mode;

detecting, by the plurality of position sensors, the rotation position of the operation lever; and in response to the pedal being stopped, adjusting, by the controller and based on the detected rotation position of the operation lever, a magnitude of the magnetic force of the stator to brake and stop the flywheel, such that when the flywheel is stopped, the operation lever is at a preset exposure position.

13. The method of claim 12, wherein the fitness bike further includes a speed sensor installed on the flywheel, and configured to detect a rotation speed of the flywheel and transmit the detected rotation speed to the controller, the method further comprising:

after the pedal is stopped, increasing, by the controller and based on the detected rotation speed of the flywheel being lower than or equal to a preset speed, the magnitude of the magnetic force of the stator to brake and stop the flywheel.

14. The method of claim 13, wherein increasing the magnitude of the magnetic force of the stator to brake and stop the flywheel comprises increasing the magnitude of the magnetic force of the stator step by step to reduce the rotation speed of the flywheel step by step.

15. The method of claim 12, wherein the fitness bike further includes a pulley rotatably installed on the frame unit and coupled to the clutch gear unit, wherein the flywheel includes a wheel body unit, and a wheel cover installed inside the wheel body unit, wherein the clutch gear unit includes a rotating gear unit coupled to the pulley to rotate together with the pulley, and a latching gear unit connected to the operation lever and rotated by the operation lever to be engaged with or separated from the rotating gear unit, and wherein, in the non-freewheel mode, the latching gear unit is engaged with the rotating gear unit such that when the pulley rotates in a forward direction and a reverse direction, the rotating gear unit, the latching gear unit, the wheel cover, and the wheel body unit are all rotated.

16. The method of claim 15, wherein, in the freewheel mode, the latching gear unit is separated from the rotating gear unit such that when the pulley rotates in the forward direction, the rotating gear unit, the latching gear unit, the wheel cover, and the wheel body unit are all rotated, and when the pulley rotates in the reverse direction, only the rotating gear unit is rotated.

17. The method of claim 12, wherein the preset exposure position is a position at which the operation lever is visually identifiable at a front side of the frame unit.

18. The method of claim 12, wherein the plurality of position sensors include two or more Hall sensors installed on the flywheel.

* * * * *